US005287944A

United States Patent [19]

Woodyard

[11] Patent Number: 5,287,944

[45] Date of Patent: Feb. 22, 1994

[54] ROOF MOUNTED ANCHOR USED SINGLY OR WITH ANOTHER, AND WITH OTHER EQUIPMENT IN A FALL RESTRAINT AND/OR FALL ARREST SYSTEM

[76] Inventor: Clifford P. Woodyard, 24322 180th SE., Kent, Wash. 98042

[21] Appl. No.: 12,909

[22] Filed: Feb. 3, 1993

[51] Int. Cl.[5] ..... A62B 35/00

[52] U.S. Cl. ..... 182/3; 182/45; 248/237

[58] Field of Search ..... 182/3, 4, 45; 248/499, 248/237

[56] References Cited

U.S. PATENT DOCUMENTS

| | | | |
|---|---|---|---|
| 3,237,717 | 3/1966 | Jackson . | |
| 3,708,145 | 1/1973 | Pestka | 248/499 |
| 3,880,405 | 4/1975 | Brueske | 248/237 |
| 4,037,824 | 7/1977 | Whitmer | 256/53 |
| 4,090,314 | 5/1978 | Mason | 248/499 X |
| 4,249,713 | 2/1981 | Glynn et al. | 248/237 |
| 4,607,724 | 8/1986 | Hillberg | 182/3 |
| 4,699,245 | 10/1987 | Benedet | 182/3 |
| 4,942,943 | 7/1990 | Flaherty | 18/5 |
| 5,011,106 | 4/1991 | Cody | 182/3 |
| 5,036,949 | 8/1991 | Crocker et al. | 182/3 |
| 5,050,705 | 9/1991 | Natwick | 182/45 |
| 5,054,576 | 10/1991 | Glynn | 182/3 |
| 5,105,907 | 4/1992 | Lebow | 182/3 |

*Primary Examiner*—Alvin C. Chin-Shue
*Attorney, Agent, or Firm*—Roy E. Mattern, Jr.

[57] ABSTRACT

For use in a fall restraint and/or fall arrest system, one or more roof mounted anchors are preferably permanently installed: during the initial construction of a building; during the renovation of a building; during the inspection time and/or maintenance time of a building; during installation and cleaning of roofs and gutters; during installation of antennas and cables, etc. Each roof mounted anchor has: a base member formed to fit a roof and having spaced holes to receive screw or screw like fasteners used in securing this anchor to the roof structure of a building; an integral upright anchoring eyelet structure secured to the base member in the center portion thereof and having an eyelet to receive portions of a cable, or hook; preferably a gusset integrally extending between the base member and the integral upright anchoring eyelet structure; and preferably the gusset has an integral cable receiving hole structure centrally located to receive and to anchor a portion of a cable. Then, when at least two roof mounted anchors are mounted on a ridge of a roof, and the base members of both are formed to match the ridge of a roof, and a cable, of a length to allow a limited sag, is positioned along the ridge of the roof and anchored at the respective ends thereof to the respective roof mounted anchors, the main anchoring components are installed.

24 Claims, 3 Drawing Sheets

FIG. 2
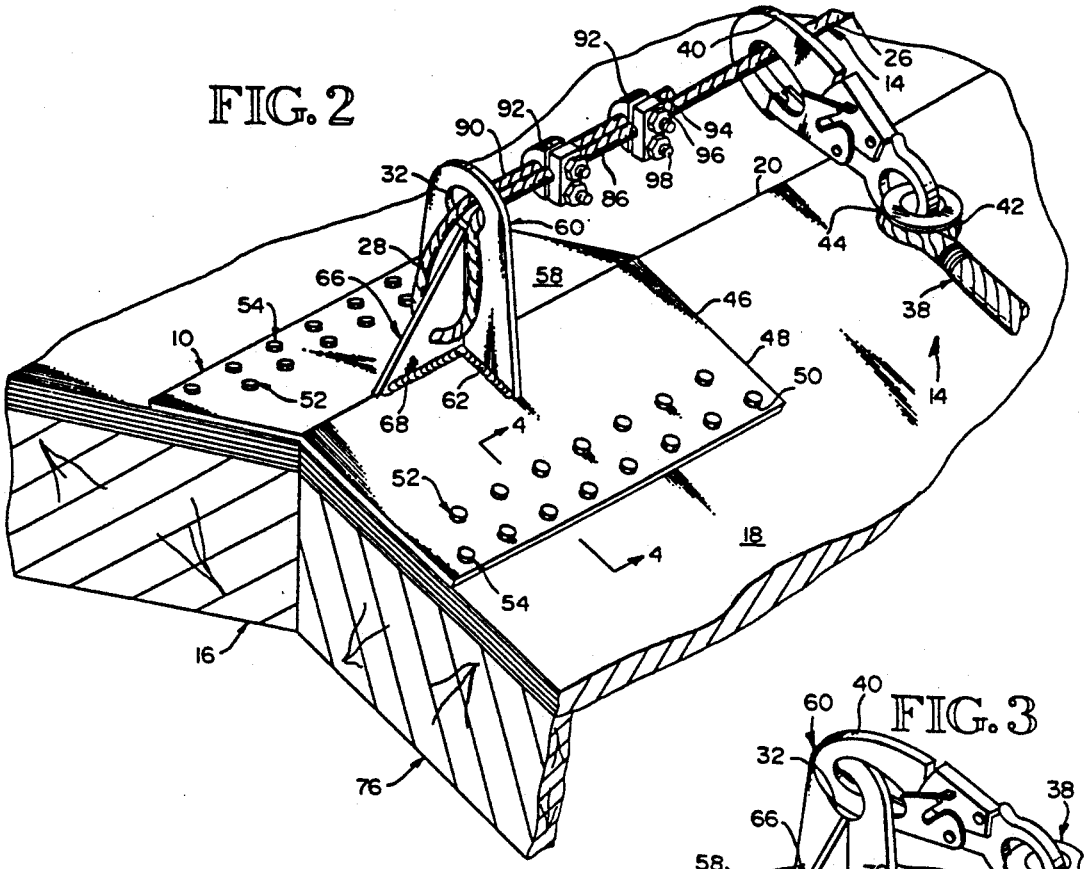
FIG. 3
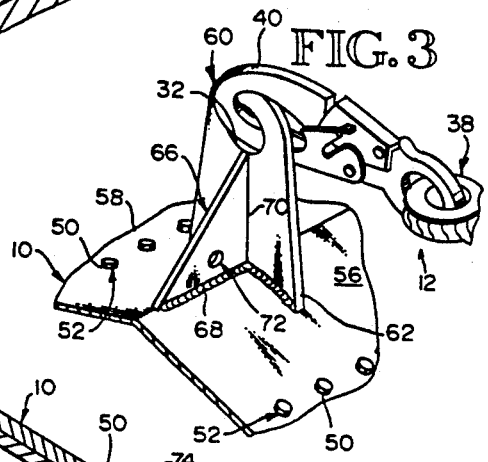
FIG. 4
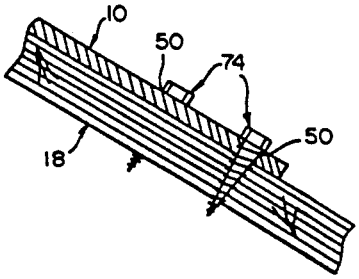
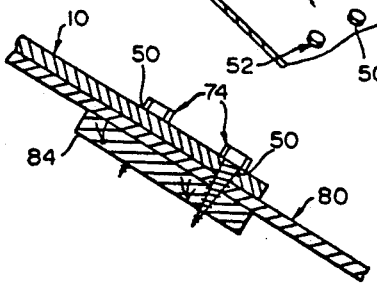
FIG. 6
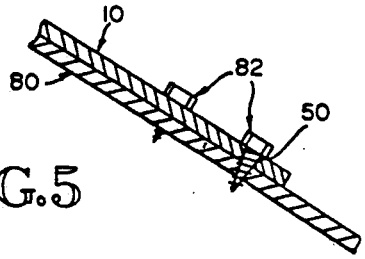
FIG. 5

FIG. 7
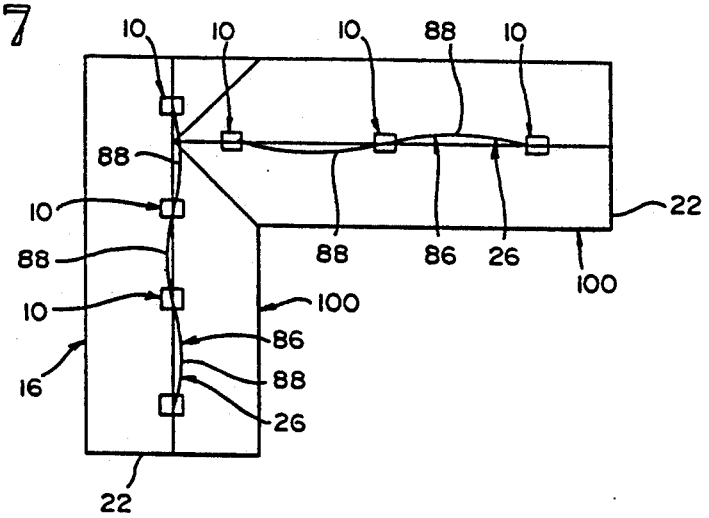
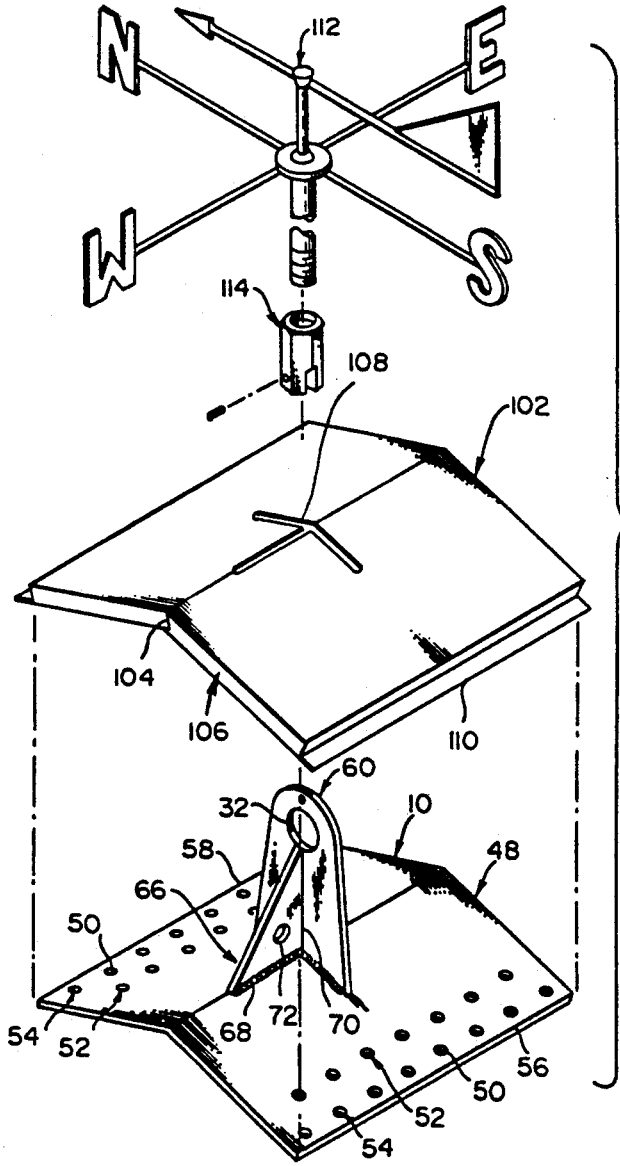
FIG. 8

ROOF MOUNTED ANCHOR USED SINGLY OR WITH ANOTHER, AND WITH OTHER EQUIPMENT IN A FALL RESTRAINT AND/OR FALL ARREST SYSTEM

BACKGROUND

In the past and currently, equipment has been used and is being used to protect work persons who are working on the roofs of buildings. Today most equipment serving this purpose, when being used, is said to constitute a fall restraint and/or fall arrest system.

In respect to such equipment set forth in U.S. patents, the following comments are made:

In 1991, William D. Glynn disclosed in his U.S. Pat. No. 5,054,576, his "roof lifeline safety system and anchor assembly therefor". He said:

The system employs a lifeline which is receivable in a casing and is extendable and retractable so as to provide a variable length from an anchoring position as the requirements of a given job may dictate. The lifeline may be a self-contained centrifugal locking-/rewinding system which employs a stainless steel cable. The lifeline is mounted in an upright bracket assembly for disposition generally above at the peak of the roof The lifeline housing is secured to the bracket assembly.

A frame receives the lifeline housing so that the line outlet from the housing is oriented upwardly from the roof peak. Shoulders extend from the frame and are oriented for surface-to-surface engagement on opposing sides of the pitched roof. Anchors are inserted through openings of the shoulders and are secured to the roof for anchoring the bracket assembly and hence the lifeline to the roof. A spring is mounted proximate the output portion of the housing surrounding the proximal portions of the extendable lifeline so as to ensure that the lifeline is spaced above the roof. A loop or carabiner at the end of the lifeline attaches to a safety belt worn by the worker.

An anchor bolt for securing the bracket assembly to the roof comprises a generally J-shaped member comprising an elongated shank having a threaded surface and a hook which engages the underside of a roof rafter. A plate defining an opening is mounted to the shank by inserting the shank through the opening. A nut is threadably engageable with the threaded surface of the shank for longitudinal displacement therealong upon application of a torque to the nut. The underside of the nut is engageable against the top of the plate. The nut comprises a pair of arms extending generally transversely thereto for torquing the nut. The upper portion of the anchor terminates in a eye. Various cable and lifelines may be connected through the eye.

The anchor is dimensioned so that it may be mounted in place by inserting the distill hook portion of the anchor so as to engage the underside of the roof rafter. The plate engages the exterior roof and the nut is tightened against the plate to thereby securely anchor the anchor bolt to the roof."

In 1981, Messrs. John H. Glynn and Patrick J. Glynn illustrated and described in their U.S. Pat. No. 4,249,713, their "roof attachment member for safety lines". They designed an attachment member for roof peaks "for use with a clip connected to a safety line for roof workers, the clip including a hook portion having a leading point with a flattened transverse section, said section having a minimum dimension and having a maximum dimension transverse to the general plane of the hook portion:

an attachment member for roof peaks to which the safety line can be clipped, comprising a strip of metal bent to define an upstanding central portion consisting of two panels of the metal integral through a 180° bend at the top, each panel being integral at its bottom with an outwardly extending leg portion having means to allow attachment to structural roof members, the metal being such as to allow deformation without rupture, the central portion having an aperture for the insertion of the hook portion of said clip, the aperture being elongated in the direction parallel with the said 180° bend, and having a length greater than said maximum dimension and a width between said maximum and minimum dimensions, whereby the clip once inserted in the aperture cannot be rotated beyond a limited arc."

In 1990, Brian J. Flaherty disclosed in his U.S. Pat. No. 4,942,943, his "roofing safety device" for use with substantially all roof configurations. A high large upright support is secured to a roof of a building. It has "at least one self-braking mechanism and cable assembly attached thereto. Disposed at the free end of the cable is a fastening device which may be secured to one of a plurality of heavy rings secured to a belt. The plurality of rings provided on the belt enables the worker to attach the cable of the self-braking mechanism to either side of his body, thereby allowing the worker to perform his task on the roof without being chafed by the cable. A pair of stabilizing struts, each having a rectangular foot at the distal ends thereof which are rotatable about a pair of orthogonal axes enables the device to conform to substantially any roof-top configuration."

In 1986, Julian T. Hillberg, illustrated and described in his U.S. Pat. No. 4,607,724, "a safety apparatus for roofers" to prevent "workers from falling off of a peaked roof includes a boom pivotally connected to a rotatable stanchion. The rotatable stanchion is supported on the roof by a saddle which is adjustable to permit it to be mounted on various peaked roofs having different slopes. A tether is connected at one end for slidable movement along the boom and is connectable at the other end to the back of a worker's safety belt or harness in order to arrest movement or catch the worker in the event of a slip or fall. The rotatable stanchion and slidable tether give the worker a high degree of mobility on the roof and without interference with work or materials on the roof. A brake operable by tension in the tether arrests rapid sliding of the tether along the boom and a pair of shock absorber devices are provided to assist the brake in reducing any jolt if a falling worker is caught by the safety device."

Other like purpose equipment which is disclosed in U.S. Patents is indicated by the following references to title of these patents:

In 1991, Messrs Crocker and Hewett Jr. in their U.S. Pat. No. 5,036,949, disclosed their "motion-stopping safety system for workers" in respect to roofs having structural members that are gripped by a C-shaped anchor;

In 1987, Rene Benedet, in his U.S. Pat. No. 4,699,245, illustrated and described his "safety device for working at great heights" on pitched roofs;

In 1991, Peter J. Natwick, in his U.S. Pat. No. 5,050,705, illustrated and described his "roof creeper kit apparatus" for use on shingle or shake roofs;

In 1966, Thomas J. Jackson, in his U.S. Pat. No. 3,237,717 disclosed his "safety rigging for roofers", working on pitched roofs;

In 1992, Dwight R. Lebow, in his U.S. Pat. No. 5,105,907, disclosed his "fall restraint cable support and method", used during the construction of steel framed buildings;

In 1977, Gerald T. Whitmer, in his U.S. Pat. No. 4,037,824, illustrated and described his "safety post" also used during the construction of steel framed buildings; and In 1975, Ralph H. Brueske, in his U.S. Pat. No. 3,880,405, a "portable personnel guard rail" used in conjunction with the metal roofing of a building.

Although these previous inventors and other inventors have provided worthwhile equipment designed to prevent injury to a work person, if he or she stumbles and falls on a roof and/or off a roof, there remains a need for another fall restraint and fall arrest system centering on a different roof mounted anchor used singly or with another, or with others.

SUMMARY

One or more roof mounted anchors, preferably permanently installed, but yet conveniently removable, if necessary, are used in a fall restraint system and/or a fall arrest system. They are selectively installed at various times, such as during: the initial construction of a building; the renovation of a building; the time of inspecting and/or maintaining a building; the installation and/or cleaning of roofs and/or gutters; the installation of antennas and/or electrical cables; etc.

Although these roof mounted anchors are shaped in several ways, preferably, in respect to the illustrated embodiment, each roof mounted anchor is an integral unit, upon completion of the fabrication thereof. Each anchor has a base member formed to fit a roof, such as the roof having a ridge as shown in the drawings. Many spaced holes are provided to receive and to position wood screws, or metal screws, or screw like fasteners, which are used in securing this anchor to the roof structure of a building. During the construction of a wood framed building, these anchors are secured to the thick plywood roof members on each side of the ridge of the roof. During the construction of a metal framed building, these anchors are secured to the metal sheet roof members on each side of the ridge of the roof. If the metal sheet roof members are thinner than fourteen gage, then wood backing is placed below the metal sheet roof members to receive the terminating ends of fasteners.

Each anchor has an integral upright anchoring eyelet structure secured to the base member in the center portion thereof. Each of these upright anchoring eyelet structures has an eyelet to receive passed through portions of a cable, or hook.

Preferably, to increase the strength of each anchor, an integral gusset is extended between the integral base member and the integral upright anchoring eyelet structure. In addition, preferably each gusset has an integral cable receiving hole structure centrally located to receive and to anchor a portion of a cable.

One of these roof mounted anchors may be installed just a few feet away from an edge of a roof. Then a work person, preferably wearing a full body harness with a secured tethered rope or cable using at least one double-locking snap hook, is able to secure this hook directly to the eyelet of the upright anchoring eyelet structure of the roof mounted anchor, to provide him or her with a fall arrest system.

When at least two roof mounted anchors are mounted on a ridge of a roof, as illustrated, and the base members are both formed to match the ridge of the roof, then, thereafter, a cable is positioned, with some slack, along the ridge of the roof and anchored at the respective ends thereof to respective roof mounted anchors, using the eyelets and cable receiving hole structures, and cable clamps, as illustrated. At this time the main anchoring components are installed.

Thereafter, each work person connects his or her individual cable or rope tether and double-locking snap hook to the anchored catenary, i.e. horizontal, length of the restraining cable. Preferably, each work person wears at least a belt with fasteners, but preferably each work person wears a complete body harness having fasteners. In so doing, each work person completes a full fall restraint system which protects him or her during working periods on and about the roof of a building.

Preferably, the roof mounted anchors are left securely in place and are galvanized or painted to last a long time. They remain ready to be quickly utilized again, when a work person must once again be on the roof to undertake and to complete a task. If desired, a decorative flashing is secured in place over most portions of the roof mounted anchor, leaving only the eyelet exposed of the top portion of the integral upright anchoring eyelet structure. Moreover, if desired, a decorative wind direction indicator assembly may be installed by removably securing it to the integral upright anchoring eyelet structure by utilizing a threaded nut structure, which is previously well secured to the integral upright anchoring eyelet structure.

DRAWING

The roof mounted anchor used singly or with another or with others, and with other related equipment in a fall restraint system and/or a fall arrest system, is illustrated in a preferred embodiment in the drawings, wherein:

FIG. 2 is a partial perspective view of portions of this pitched roof structure having a ridge, as shown in FIG. 1, illustrating how the catenary, i.e. horizontal, cable shown in FIG. 1, at one end thereof, is secured to a near end roof mounted anchor using two cable clamps, and thereafter the work person's tethered rope is slidably secured to the catenary cable using a double-locking snap hook;

FIG. 3 is a partial perspective view of portions of the roof mounted anchor, showing how the work person's tethered rope is initially secured to a roof mounted anchor, using a double-locking snap hook, when the catenary cable is being arranged; or if only a single roof mounted anchor is used on a roof, then such a direct securement to the roof mounted anchor is undertaken;

FIG. 4 is a partial sectional view of portions of a roof mounted anchor, and of a roof of wood structure, illustrating the securement of the roof mounted anchor to the plywood, or structural wood, by using wood screws;

FIG. 5 is a partial sectional view of portions of a roof mounted anchor, and of a roof of metal structure, illustrating the securement of the roof mounted anchor to the overlapping metal roof portions by using metal screws, or metal-like screw fasteners;

FIG. 6 is a partial sectional view similar to FIG. 5, but showing how a wood backing piece is used, when thinner metal roofs are installed, and then the wood holding screws pass through the metal portions and enter the wood backing piece;

Figure 1:
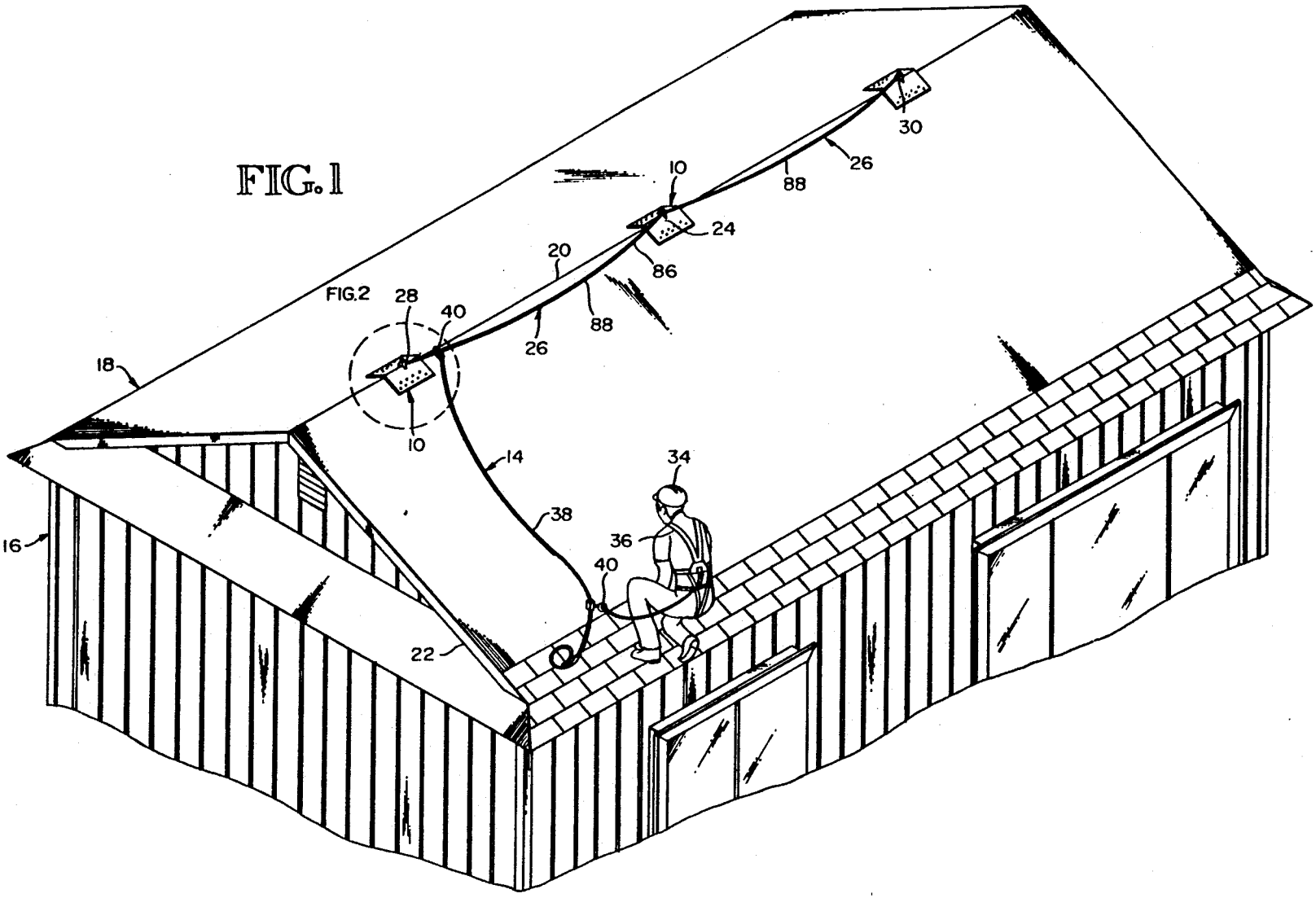
FIG. 1 is a partial perspective view of the top portions of a wood structure building illustrating how a work person on a pitched roof having a ridge, is securely tethered to a fall restraint system and/or fall arrest system which utilizes the roof mounted anchors, as he or she is securing shingles to the roof.

FIG. 7 is a schematic top view of a building having a pitched roof, having ridges extending in two directions, to illustrate the placement of several roof mounted anchors; and FIG. 8 is an exploded perspective view of: a roof mounted anchor; an optional decorative flashing positioned above and ready to be placed over this anchor, leaving only the eyelet of the anchor exposed; and an optional wind vane assembly ready to be secured to the top of the roof mounted anchor.

DESCRIPTION OF PREFERRED EMBODIMENT

Introduction

The illustrated embodiment of the roof mounted anchor 10, used singly or with another, or with others, and with other related equipment provides a fall arrest system 12 for one work person working on a roof, or a fall restraint system 14 for up to four work persons working on a roof, when used as illustrated and described. These systems 12 and 14 meet and/or exceed current governmental requirements.

The roof mounted anchor 10 is preferably permanently installed; however, it is comparatively conveniently removable, if necessary. It is installed on new buildings and existing buildings. It is installed on all roof types such as wood, metal, composition, tile, and cedar shake roofs, which in turn have either wood or steel framing members.

In FIG. 1 a wood structure building 16 is illustrated showing a pitched roof 18, having a ridge 20 extending forty four feet. Spaced six feet in from each gable end 22 of the roof 16, are roof mounted anchors 10. Then in the center 24 of the ridge 20, a third roof mounted anchor 10 is mounted. The spacing between these three roof mounted anchors 10 is then sixteen feet, which is the maximum spacing in respect to this preferred embodiment.

A catenary, i.e. horizontal, cable 26 is secured at each end 28, 30 thereof, to the near end positioned roof mounted anchors 10, and it passes through an eyelet 32 of the third roof mounted anchor 10 mounted in the center 24 of the ridge 20. A work person, preferably wearing a hard hat 34, and a full body harness 36, secures herself or himself to the catenary cable 26 using currently available and specified lifeline ropes 38 double-locking snap hooks 40 attached to the rope 38, and respectively to the full body harness 36 and the catenary cable 26, as shown in FIGS. 1 and 2, indicating also the integral end loop 42 at one end 44 of the lifeline rope 38.

As shown in FIG. 3, when only one roof mounted anchor 10 is ever to be used, or when only one roof mounted anchor 10 is installed, with others to be installed later, then a work person is able to directly secure his or her double-locking snap hook 40 through the eyelet 32 of this one roof mounted anchor 10.

The Roof Mounted Anchor

The roof mounted anchor 10 in the pitched roof embodiment illustrated in the drawings, is fabricated from both one eighth and three sixteenths of an inch thick rolled steel 46. The base member 48 is twelve inches long and twelve inches wide and one eighth of an inch thick. Thirty, five sixteenths of an inch in diameter holes 50 are staggerdly spaced in four rows, 52, 54, with fifteen holes 50 and two rows 52, 54 located on each side 56, 58 of this base 48.

An integral upright anchoring eyelet structure 60 is welded to the base member 48. It is made from three sixteenths of an inch thick rolled steel 46. It is five and one quarter inches high, four inches wide at the base 62 thereof, and two and three quarters of an inch wide at the eyelet 32, which is one and one half inches in diameter.

An integral gusset 66 is welded to both the base member 48 and the upright side anchoring eyelet structure 60. Preferably it is positioned on their center lines, so later the gusset 66 is aligned with the ridge 20 of the roof 18. It is made from three sixteenths of an inch thick rolled steel 46. Both the base 68 and the upright side 70 of each triangular shaped gusset 66 are three inches in length. A one half inch diameter cable receiving hole 72 is centrally located through the gusset 66.

Installation of the Roof Mounted Anchor on a Roof Structure

In partial cross sectional views, such as the cross sectional view of FIG. 4, taken along line 4—4 of FIG. 2, the fastening of the roof mounted anchor 10 to the roof structure of a building is illustrated.

In FIG. 4, wood screw fasteners 74, such as those numbered fourteen-ten, which are one and one half inches long, are passed through a hole 50 in the base member 48 of roof mounted anchor 10, and then threaded into and beyond the thickness of three quarters of an inch thick plywood board or lumber piece of the roof 18 of a wood structure building 16, having wood trusses 76. Thirty of these wood screws are used, as particularly shown in FIG. 2, in respect to the illustrated encircled area presented in FIG. 1, where a roof mounted anchor 10 is installed, six feet in from a gable end 22 of a ridge roof 18.

When metal roofs 80, as thick as fourteen gage or thicker, are installed over roof trusses, then, preferably, metal screw like fasteners 82 are used, such as those numbered one quarter of an inch-fourteen, which are three quarters of an inch long. Some metal fasteners of this type of metal screw like fasteners 82, are designated as "tek" fasteners. The use of these fasteners 82 is illustrated in FIG. 5, when the metal roof material is at least fourteen gage metal or thicker.

When, however, metal roofs 80 are made of metal less thick than fourteen gage metal, then as shown in FIG. 6, a wood backing member 84, either plywood or dimensional lumber, preferably of a minimum thickness of three quarters of an inch, is used as the backing member 84. Thereafter, the wood screw fasteners 74 are used to complete the installation of the roof mounted anchor 10 to these thinner metal roofs 80 backed by wood backing member 84, where the fasteners 74 are installed.

The Catenary i.e. Horizontal, Line, i.e. Cable

A cable 26 of three eighths of an inch in diameter is used as the catenary line 86 extending between the two end roof mounted anchors 10, and passing through the eyelet 32 of the third or centered roof mounted anchor 10, as shown in FIGS. 1 and 7. As shown, each portion 88 of the cable 26 extending between the roof mounted anchors 10 is preferably arranged so that it sags, becoming a sagging portion 88 of the catenary line 86. The cable 26 must not be stretched tight. At least there must be twelve to eighteen inches of sag or drop in the cable 26 between attachment points. As an example, for a ridge length of fifty feet of cable between the end anchors 10, an allowance of six feet of cable length is added. Therefore, the overall cable starting length will be fifty six feet. This extra six feet is adequate for securing the cable ends 28 or 30, and leaving the proper sag or drop of the cable 26.

As illustrated in FIG. 2, each cable end 28 or 30 is secured at a roof mounted anchor 10 by: first passing it through the eyelet 32 of the upright anchoring structure 60; then passing it down through the cable receiving hole structure 72 in the gusset 66; and thereafter returning it back through the eyelet 32, to extend it for a length 90, which is parallel and adjacent to itself in respect to the catenary line 86. Two cable clamps 92 are mounted at spaced locations along this length 90 of the returned cable 26 at the respective cable ends 28, 30. The nuts 94 and nut ends 96 of the cable bolts 98 are positioned on the catenary line side of these parallel and adjacent portions of the cable 26.

The Individual Work Person's Lifeline Rope, Double Ring, Double Locking, Hooks, Full Body Harness and Hard Hat In completing a fall restraint system or a fall arrest system, previously available and now available equipment is utilized such as the lifeline rope 38, double-locking snap hooks 40, full body harness 36, and hard hat 34, which are illustrated in FIGS. 1, 2, and/or 3.

The Arrangement of More Roof Mounted Anchors on a More Extensive Roof Structure

In respect to the preferred spacing of installed roof mounted anchors 10, three of them were shown in FIG. 1. Each near end position roof mounted anchor 10 was installed six feet in from the gabled end 22 of the pitched roof 18. Then on a roof extending forty four feet, the third roof mounted anchor 10 was centrally located on the ridge of the roof 18, sixteen feet apart respectively from each near end anchor 10. Thereafter the two sagging cable portions 88 themselves extended in respect to their own lengths more than the maximum preferred spacing of sixteen feet along the ridge 20 of the roof 18 for the spaced apart roof mounted anchors 10. In this way the catenary line or cable 86 is always known not to be prestressed. As noted previously, there must be a twelve to eighteen inch sag or drop in the cable 26 between the attachment points or places.

As observed, especially in FIG. 2, the near end positioned roof mounted anchors 10 always have their respective gussets 66 positioned nearer the respective gable ends 22 of the roof 18, to properly position their respective cable receiving holes 72. These holes 72 are subsequently utilized when the respective cable ends 28, 30 are secured to these near end positioned roof mounted anchors 10.

This same spacing of the roof mounted anchors 10 is followed when other roofs 100 of other larger sizes and/or of other configurations are equipped with spaced roof mounted anchors 10, as illustrated, by way of an example, in FIG. 7. Two roof portions meet together at right angles. One catenary line 86 extends for a greater distance than the second catenary line 86 extending at right angles to the first one. The near end positioned roof mounted anchors 10 are positioned six feet from a respective gable end 22, and all the in between spaced roof mounted anchors 10 are not spaced more than sixteen feet apart. Again there is a sagging cable portion 88, or, are sagging cable portions 88, to insure the cables will not be prestressed.

An Optional Flashing for Installation Over the Roof Mounted Anchor

Although each roof mounted anchor 10 is galvanized using zinc, or is painted, where the roofs of buildings are to be observed and/or where better protection against the perils of bad weather is wanted, then a flashing 102 is provided, as illustrated in FIG. 8. This flashing 102 is made in a roof like angular configuration out of sheet metal. It has a slit opening 104 in each depending end side 106 to permit angular adjustments. Also it has a top central slit opening 108 to accommodate both the top of the upright anchoring eyelet structure 60, and the gusset 66, keeping the eyelet 32 available for receiving and positioning a catenary line 86, or a double-locking snap hook 40. This flashing 102 is galvanized and/or painted in selectable various colors. It is held in place by utilizing at least four fasteners, such as the fasteners 74 or 82, which are first passed through holes to be made in a respective extending flange 110 of the flashing 102 and then secured into structure of the roof 18. Overtightening of these fasteners used to secure the flashing 102 is avoided, so the flashing 102 will not be distorted and/or buckled. After the flashing 102 is installed, a small bead of waterproof sealant, not shown, is applied both to flashing portions and to adjacent portions of the upright anchoring eyelet structure 60 and the gusset 66, where they emerge through the top central slit opening 108 of the flashing 102. This completes a waterproof mounting of this flashing 102 over the roof mounted anchor 10.

An Optional Wind Vane for Installation on and Over the Roof Mounted Anchor

If a wind vane assembly 112 is wanted, for example, on a roof 18, the roof mounted anchor 10, with or without a flashing 102, may be used to mount it, as shown in FIG. 8. An internally threaded fastener body 114 is selectively secured by a fastener assembly, not shown, or welded, not shown, to the top portion of the upright anchoring eyelet structure 60, without reducing the access to the eyelet 32. Thereafter, the wind vane assembly 112 is rotatably mounted securely in place, as its standard externally threaded mating portion 116 is threaded into the internally threaded fastener body 114, which has been previously secured to the roof mounted anchor 10.

Reference to a Specific Test Wherein Two Spaced Roof Mounted Anchors Supported a Catenary Cable, a Restraint Tether Was Tested in Respect to the Cable and an Arrest Tether Was Tested in Respect to One of the Roof Mounted Anchors Tests were made to determine the holding power of two spaced roof mounted anchors 10 made like the described preferred embodiment. In respect to a restraint tethered lifeline rope 38 and its respective double-locking snap hooks 40, when it was attached to the catenary line or cable 86, test loads ranging from three thousand to fifty four hundred pounds were successfully undertaken, without causing any failures of the fall restraint system 12. In respect to an arrest tethered lifeline rope 38 and its respective double-locking snap hook 40, when it was attached directly to a roof mounted anchor 10, a test loading at fifty four hundred pounds was successfully undertaken, without causing any failure of the fall arrest system 14.

These Roof Mounted Anchors Reliably Serve as Efficient, Economically Produced, Installed and Maintained Basic Components of Both Fall Restraint Systems and Fall Arrest Systems The roof mounted anchors 10, as illustrated in this preferred embodiment and particularly installed on pitched roofs 18, having a ridge 20, present an eyelet 60 facing the direction of ridge 20, and positioned directly over the ridge 20, when the upright anchoring eyelet structure 60 is preferably centrally positioned and welded on the base member 48 of the roof mounted anchor 10. This eyelet 60 conveniently receives a cable portion of a catenary line 86 or a hook portion of a double-locking snap hook 40 secured to a lifeline rope 38 assembly, after the convenient and very secure installation of the roof mounted anchor 10, which previously has been economically produced and handled. Preferably, the roof mounted anchor 10, once installed, remains installed for a long time, being ready to perform the anchoring function, whenever a fall restraint system 12 and/or a fall arrest system 14 is to be completed, when a work person or work persons must safely work on a roof 18 of a building 16.

Optionally, a flashing 102 is reliably fitted essentially over most of the roof mounted anchor 10, while leaving full access to the eyelet 32 thereof. This flashing 102 is economically made, installed, and made watertight. Also optionally, a wind vane assembly 112, is economically installed. When the flashing 102 and/or the wind vane assembly 112 are installed, they respectively add to the aesthetic appearance of the roof 18. Moreover, when the flashing 102 is sealed in place, a very waterproof installation is completed.

I claim:

1. A roof mounted anchor used by itself or used with other roof mounted anchors, and also used with other components of a workperson's fall restraint and/or fall arrest equipment, to protect a workperson from serious injury, if he or she were to fall while working on a roof, comprising:

a) a base member having spaced holes to receive fasteners which will be used to secure this roof mounted anchor to roof structures of a building;

b) an upright anchoring eyelet structure secured to the central portion of the base member having an eyelet to receive portions of a cable, or hook;

c) a gusset, serving as a reinforcement member and extending between the base member and the upright anchoring eyelet structure; and d) a cable receiving hole structure integrally and centrally located in the gusset to receive and to anchor a portion of a cable.

2. A roof mounted anchor, as claimed in claim 1, wherein the base member is formed to match the surface structure of a roof.

3. A roof mounted anchor, as claimed in claim 1, wherein the base member is bi-planar, creating an angle to closely fit along a selected length of a ridge of a pitched roof.

4. A roof mounted anchor, as claimed in claim 3, wherein the upright anchoring eyelet structure is positioned on the base member to subsequently present the eyelet thereof in alignment with the direction of a ridge of a pitched roof.

5. A roof mounted anchor, as claimed in claim 4, wherein the gusset is positioned to be subsequently in alignment with the direction of the ridge of a pitched roof.

6. A roof mounted anchor, as claimed in claim 5, wherein the gusset is located on a centerline of the base member, and this centerline is subsequently aligned with the ridge of a pitched roof.

7. A roof mounted anchor, as claimed in claim 6, combined with another like roof mounted anchor to be mounted at selected spaced apart locations along the ridge of a roof and thereafter these combined roof mounted anchors serve to anchor respective end portions of a cable extending between these combined roof mounted anchors.

8. A roof mounted anchor, as claimed in claim 7, as combined with another like roof mounted anchor, wherein their respective gussets are positioned to be on the respective ends of these roof mounted anchors which face respective gable ends of a ridge of a roof.

9. A roof mounted anchor, as claimed in claim 8, as combined with another like roof mounted anchor, wherein these roof mounted anchors are secured to roof structure at a location of at least six feet in from a gable end of a roof.

10. A roof mounted anchor, as claimed in claim 9, as combined with another like roof mounted anchor, and then if the distance between these two roof mounted anchors exceeds sixteen feet, at least a third roof mounted anchor will be secured to a roof structure between them, so no space between these multiple roof mounted anchors will exceed sixteen feet.

11. A roof mounted anchor, as claimed in claim 6, having fasteners for placement in the spaced holes of the based member.

12. A roof mounted anchor, as claimed in claim 11, wherein the fasteners used with respect to a wood roof structure having three quarters of an inch thick wood members, are number 14–10×1½" wood screws.

13. A roof mounted anchor, as claimed in claim 11, wherein the fasteners used with respect to a metal roof structure of a minimum 14 gauge metal, are number ¼"–14×¾" tek fasteners.

14. A roof mounted anchor, as claimed in claim 11, wherein the fasteners used with respect to a metal roof structure having a gauge less than the 14 gauge metal roof structure, are number 14–10×1½" wood screws and a wood backing is installed under the metal roof structure into which the wood screws are sufficiently driven.

15. A roof mounted anchor, as claimed in claim 9, as combined with another like roof mounted anchor, are further combined with a cable, having each cable end positioned through a respective eyelet and beyond through a respective cable receiving hole and then returned through the respective eyelet, and placed alongside the cable extending to the other like roof mounted anchor, for a distance sufficient, so the cable end is tightly held to extending cable by having two spaced cable clamps well tightened about these cable portions which are positioned alongside one another.

16. A roof mounted anchor, as claimed in claim 15, as combined with another like roof mounted anchor and they anchor the cable, when at least one other like roof mounted anchor is used, the cable is positioned through the eyelet thereof.

17. A roof mounted anchor, as claimed in claim 15, as combined with another like roof mounted anchor, when the cable is anchored, the cable sags.

18. A roof mounted anchor, as claimed in claim 6, having a flashing covering all portions thereof, except for the eyelet of the upright anchoring eyelet structure.

19. A roof mounted anchor, as claimed in claim 18, wherein the flashing is bi-planar, creating an angle to closely fit over the roof mounted anchor.

20. A roof mounted anchor, as claimed in claim 19, wherein the flashing has depending portions which are split to accommodate angular adjustments.

21. A roof mounted anchor, as claimed in claim 20, having a securement assembly attached to the upright anchoring eyelet to in turn receive a weather vane assembly.

22. A roof mounted anchor, as claimed in claim 6, which is designed to meet government requirements, is made in reference to sizes and materials, as follows:

a) the base member is made from ⅛" thick rolled steel, 12" long and 12" wide, there are thirty 5/16" diameter spaced holes, fifteen of them located on each side thereof;

b) the upright anchoring eyelet structure is welded to the base member and is made from 3/16" thick rolled steel, 5¼" high, 4" wide at the base thereof, 2¾" wide at the eyelet location, and the eyelet is 1½" in diameter; and c) the gusset is welded to both the base member and the upright anchoring eyelet structure, and is made from 3/16" thick rolled steel, both the base and upright sides of the triangular shaped gusset are 3" in length, the cable receiving hole is ½" in diameter.

23. A roof mounted anchor, as claimed in claim 22, having a galvanized surface.

24. A roof mounted anchor, as claimed in claim 22, having a painted surface.

* * * * *